United States Patent [19]

Bailly-Lacresse et al.

[11] 4,197,282

[45] Apr. 8, 1980

[54] MANUFACTURE OF CARBON FIBRES

[75] Inventors: Jean-Francois G. Bailly-Lacresse, St. Gratien; Alain P. Crepaux, Lavera; Philippe G. J. Thomas, Aix-en-Provence; Albert Bonzom, Sausset les Pins, all of France

[73] Assignee: The British Petroleum Company Limited, Sunbury on Thames, United Kingdom

[21] Appl. No.: 902,673

[22] Filed: May 4, 1978

[30] Foreign Application Priority Data

May 25, 1977 [FR] France ..... 77 15990

[51] Int. Cl.[2] ..... D01F 9/14

[52] U.S. Cl. ..... 423/447.4; 264/29.2; 423/447.2; 423/447.6

[58] Field of Search ..... 423/447.1–447.4, 423/447.6–447.8; 264/26, 29.2

[56] References Cited

U.S. PATENT DOCUMENTS

| | | | |
|---|---|---|---|
| 3,595,946 | 7/1971 | Joo et al. | 423/447.6 |
| 3,607,063 | 9/1971 | Douglas | 423/447.1 |
| 3,702,054 | 11/1972 | Araki et al. | 423/447.6 |
| 3,919,376 | 11/1975 | Schulz | 423/447.4 X |
| 3,974,264 | 8/1976 | McHenry | 423/447.6 |

FOREIGN PATENT DOCUMENTS

| | | | |
|---|---|---|---|
| 47-24186 | 7/1972 | Japan | 423/447.1 |
| 1261353 | 1/1972 | United Kingdom | 423/447.7 |

*Primary Examiner*—Edward J. Meros

*Attorney, Agent, or Firm*—Morgan, Finnegan, Pine, Foley & Lee

[57] ABSTRACT

The invention relates to a process for the manufacture of carbon and/or graphite fibres from natural organic fibres, obtained particularly from the distillation residues of coal or petroleum, by irradiation by microwaves.

The process according to the invention consists in subjecting the fibres to a preparatory thermal treatment up to a temperature of between 300° and 1500° C. in an inert atmosphere, for example of nitrogen, argon, helium or hydrogen and then irradiating them with microwaves.

The microwaves may have frequencies between 900 and 30,000 MHz and preferably between 2000 and 15,000 MHz and use a power of between 10W and 30kW and preferably between 50W and 10kW. The irradiation is preferably also in an inert atmosphere, for a period ranging from 10 seconds to 15 minutes. The fibres may be oxidized for example in an atmosphere of oxygen, ozone or air up to a temperature of between 100° and 250° C. before the preparatory thermal treatment.

The carbon and/or graphite fibres thus obtained, having an improved breaking strength, are used particularly for the reinforcement of plastic materials.

14 Claims, No Drawings

MANUFACTURE OF CARBON FIBRES

The present Invention relates to a process for the manufacture of carbon and/or graphite fibres from fibres obtained by spinning natural organic materials, particularly distillation residues of coal or petroleum.

The use of carbon or gaphite fibres for the reinforcement of certain plastic materials makes it possible to obtain composite materials whose mechanical properties, for example the ratios of the modulus of elasticity and breaking strength to the specific gravity, are higher than those of metals.

Carbon and graphite fibres are manufactured at the present time in various ways, and in particular:

by the carbonisation and possibly graphitisation of an already spun product which is a polymer precursor, e.g. cellulose, acrylic derivatives and in particular polyacrylonitriles, by the spinning, carbonisation and possibly graphitisation of a molten organic product, e.g. coal tar pitches, PVC pitches, petroleum derivatives and asphalts.

Carbonisation is achieved by a thermal treatment under an inert atmosphere, converting the initial organic material into carbon. In order to obtain graphite fibres, this treatment is supplemented by a more advanced thermal treatment (up to 2800° C.) which makes it possible to obtain very strong fibres.

It is known that certain materials can be heated by irradiation with high frequency electromagnetic waves, particularly with hyperfrequencies. The rise in temperature comes from various processes of degradation of the high frequency energy applied to the materials. At ordinary temperature the losses by dipolar relaxation increase with the frequency and are at a maximum when using microwaves. When the temperature increases, the losses by conduction, bound up with the thermal activity of the free charges, increase more rapidly than the losses by dipolar relaxation, and then become preponderant even with microwaves.

The object of a thermal treatment using microwaves (wavelengths from a few mm to 10 cm) is to obtain a rapid rise in temperature both in the interior and on the periphery of the subject to be treated.

In the case of carbon fibres, the use of hyperfrequencies is particularly useful for obtaining a homogenous carbonisation of the initial fibres and thus improve the mechanical properties of the final fibres. The use of microwaves is even more potentially useful for obtaining graphite fibres, as the graphitation treatments require temperatures higher than 2000° C., temperatures reached very rapidly by materials subjected to hyperfrequencies.

The use of microwaves for the manufacture of carbon fibres has already been proposed in Japanese Pat. Specification No. 4724186 published on the July 4, 1972. However, this treatment by microwaves is applied to synthetic fibres such as polyacrylonitrile fibres, and not to fibres obtained from natural products such as petroleum residues or the residues of the distillation of coal.

The Applicant's invention uses, as initial material for the manufacture of carbon and/or graphite fibres, fibres coming from natural products such as the distillation residues of coal or petroleum, which are much cheaper than a classic raw material of the polyacrylonitrile type.

However, it was found that the fibres obtained by spinning petroleum residues or coal distillation residues were too insulating for the electromagnetic field applied during the irradiation with microwaves to be able to exert an action on them. The molecules of which they are made are, in fact, non-polar.

The Applicants then discovered that is was possible to obtain carbon and/or graphite fibres from organic fibres derived from natural products such as coal or petroleum distillation residues by subjecting the latter, prior to their irradiation by microwaves, to a preparatory thermal treatment up to a temperature of between 300° and 1500° C.

The preparatory thermal treatment produces an initial carbonisation. Interaction between the microwaves and the fibres then becomes possible.

The present invention, therefore, is concerned with a process for the manufacture of carbon and/or graphite fibres from natural organic fibres, particularly those obtained from residues of the distillation of coal or petroleum, by irradiation by microwaves, in which the fibres, prior to their irradiation by microwaves, are subjected to a preparatory thermal treatment in an inert atmosphere up to a temperature of between 300° and 1500° C., and preferably between 400° and 1000° C.

The invention also includes carbon and/or graphite fibres so obtained.

The natural organic fibres may be obtained by spinning a molten organic product which may be chosen from coal tar pitches, pitches obtained from steam cracking residues of petroleum fractions, for example as described in the Applicant's French Pat. application No. 73 40152, or pitches obtained from petroleum crude oil residues.

The initial fibres may have a KS softening point (Kraemer-Sarnow) of between 100° and 250° C., and more particularly between 180° and 250° C. Their Conradson carbon content determined according to NFT method 60 116 may be lower than 80 percent by weight.

The process of manufacture of carbon and/or graphite fibres according to the invention may include giving the fibres an initial oxidation treatment up to a temperature of from 100° to 250° C., and preferably from 150° to 250° C. This oxidation treatment oxidises the surface layer of the fibre and renders it infusible, thus making possible the treatment of the fibre at high temperature without modifying its shape and without causing adhesion between the fibres.

The oxidation treatment may be carried out using a rate of increase of temperature of 0.1° to 0.5° per minute.

For fibres with a KS softening point lower than 150° C., the oxidation may take place in the liquid phase, it being then possible to choose a liquid oxidising agent, e.g. nitric acid, sodium hypochlorite, hydrogen peroxide, potassium dichromate or, preferably, potassium permanganate.

For fibres with a KS softening point higher than 150° and preferably higher than 170° C., the oxidation may be carried out with a gaseous oxidising agent, e.g. oxygen, ozone or, preferably, air.

The oxidation treatment may then be followed according to the invention by a preparatory thermal treatment of the oxidised fibres in an inert atmosphere up to a temperature of between 300° and 1500° C. and preferably between 400° and 1000° C. The inert atmosphere may be obtained by using a gas which does not react chemically with the fibres and is resistant to the temperatures reached, e.g. nitrogen, argon, helium or hydrogen.

This thermal treatment preparatory to the irradiation may be carried out after the oxidation by changing the gaseous atmosphere and raising the temperature up to 300° to 1500° C. and preferably 400° to 1000° C. After this preparatory thermal treatment, the Conradson carbon content may be higher than 83 percent by weight and preferably at least 88 percent by weight.

For this thermal treatment, it is preferred to use a rate of increase of temperature of 0.5° to 1° C. per minute up to 420° C., of 0.1° to 0.5° C. per minute from 420° to 450° C. and of 1° to 5° C. per minute beyond 450° C. It is observed that between 400° and 450° the rate of increase of temperature is desirably slow. In the case where pitch is used as the initial material, this temperature range is the range for the conversion of pitch to mesophase, the mesophase being the intermediate phase prior to carbonisation. This conversion of pitch to mesophase is the change which initiates interaction between the microwaves and the fibres.

After the preparatory thermal treatment the fibres thus obtained are subjected to a carbonisation and/or graphitisation treatment by irradiation with microwaves also preferably in an inert atmosphere. The irradiation by microwaves may be carried out immediately after the preparatory thermal treatment or else discontinuously, by storing the thermally pre-treated fibres and then irradiating them subsequently, e.g. on a support of refractory material which is inert to microwaves. The inert atmosphere may be obtained in the same way as described above for the preparatory thermal treatment. The treatment of carbonisation and/or graphitisation by microwaves is carried out at temperatures of between 400° and 2800° C. and preferably between 1000° and 2000° C.

The irradiation by microwaves preferably uses an electromagnetic radiation whose frequency is between 900 MHz and 30,000 MHz and preferably between 2000 MHz and 15,000 MHz. The power may be between 10 W and 30 kW, preferably between 50 W and 10 kW.

The Applicants have found that the use of frequencies higher than 2000 MHz makes it possible to improve the efficacy of the treatment by microwaves: the lower value of the electric field for a given power input makes it possible to use higher power inputs and therefore to reach higher temperatures without creating electric discharges between the fibres. That is why the process most preferably uses the highest frequencies, e.g. higher than 5000 MHz and more particularly higher than 8000 MHz.

The duration of the irradiation by microwaves may be between 10 seconds and 15 minutes and preferably between 15 seconds and 3 minutes.

The treatment by microwaves may be carried out by passing the fibres into a cavity capable of receiving a microwave radiation of sufficient frequency, preferably higher than 2000 MHz. The generation of the hyperfrequencies may be provided by an apparatus of the magnetron or klystorn type or any other generator which makes it possible to obtain an electromagnetic radiation of sufficient frequency.

The fibres obtained by the process developed by the Applicants may have breaking strengths of between 1000 and 10,000 kgf/cm$^2$ which, taking into account the low cost price of the raw material as compared with a classic raw material of the polyacrylonitrile type, makes it possible to obtain relatively cheap composite materials having a much improved mechanical strength. In practice, the initial fibres used in the present Invention have very low breaking strengths of between 200 and 1500 kgf/cm$^2$.

The Invention is illustrated by the following examples:

EXAMPLE 1

The initial material used was a yarn of fibres prepared by spinning a pitch obtained by the thermal treatment of a residue from the steam cracking of naphtha. The properties of this pitch were as follows:

| | |
|---|---|
| Density at 20° C. | 1.23 |
| VS softening point (Kraemer-Sarnow) | 183—185° C. |
| $\beta$ resins (insoluble in toluene or benezene but soluble in quinolein or anthracene oil) | 31% by weight |
| $\alpha$ resins (insoluble in quinolein or in an antracene cut) | less than 0.1% by weight |
| % insolubles in hexane ($\alpha + \beta$ resins) | 70.5 |
| Conradson carbon (% by weight) | 63.6 |

This yarn of fibres was subjected to an oxidation treatment under air up to a temperature of 250° C. for a period of 1 hour.

The oxidised fibres were introduced into a support of refractory material, inert to microwaves, consisting of a silica tube placed in a wave guide applicator. The energy which passed through the sample was sent back to the sample itself by a short circuit, the position of which was adjusted so as to place the fibres in an energy loop. The coefficient of absorption of the fibres (ROS, i.e. the ratio of stationary waves) was plotted as a function of the frequency.

The ratio of stationary waves was always higher than 20 whatever the frequency, i.e. there was poor interaction between the microwaves and the fibres which made the initiation of the carbonisation impossible.

EXAMPLE 2

A yarn of pitch fibres as prepared in the same way as Example 1. The yarn of fibres was subjected to an oxidation treatment under air up to a temperature of 250° C. for a period of 1 hour. and then to a thermal treatment under nitrogen up to a temperature of 1000° C. for a period of 4 hours.

The ratio of stationary waves determined on these oxidised fibres which had undergone the thermal treatment was always less than 6.

The oxidised and thermally pre-treated fibres were placed in a support of refractory material, inert to microwaves, in the same way as in Example 1.

The microwave generator used was a magnetron emitting waves of 2450 MHz, and having a maximum power of 1 kW. The microwave generator was fed to the applicator through a circulator.

The pitch fibres were irradiated at a power of 80 W, the duration of irradiation being 3 minutes.

The fibres were heated bery rapidly until they reached a temperature of approximately 1700° C. The breaking strength of the carbon fibres obtained was 3000 kgf/cm$^2$.

EXAMPLE 3

A yarn of pitch fibres was prepared in the same way as in Example 1. The oxidation treatment and the thermal pre-treatment were carried out as in Example 2.

The fibres were placed in an applicator, operating on the same principles as in Example 2. The microwave generator used was a klystron producing microwaves of a frequency of 10 GHz (band X).

The fibres reached a temperature of at least 1700° C. as shown by the fusion of the supporting silica.

Irradiation at a power of 500 W was applied for a period of 3 minutes.

The breaking strength of the carbon fibres obtained was 4500 kgf/cm$^2$.

EXAMPLE 4

A yarn of pitch fibres prepared in the same way as in Example 1 was subjected to an oxidation and a preparatory thermal treatment under the same conditions as given in Example 2, except that the thermal pre-treatment was stopped when the fibres had reached a temperature of 450° C.

The oxidised and thermally pre-treated fibres were subjected to and irradiation with microwaves of a frequency of 10 GHz in the same apparatus as that described in Example 2. The irradiation was carried out under the following sets of conditions:

(1)

Power applied: 1 kW
Irradiation time: 1 minute 20 seconds
Breaking strength of carbon fibres obtained: 1000 kgf/cm$^2$ (2)

Power applied: 700 W
Irradiation time: 3 minutes
Breaking strength of the carbon fibres obtained: 2000 kgf/cm$^2$

We claim:

1. A process for the manufacture of carbon and/or graphite fibers which comprises subjecting fibers obtained by spinning a product chosen from coal tar pitches, pitches obtained from residues of the steam cracking of petroleum fractions or pitches obtained from petroleum crude oil residues to a preparatory thermal treatment comprising raising the temperature to at least 450° up to 1000° C. in an inert atmosphere and thereafter subjecting the fibers to irradiation with microwaves to effect carbonisation and/or graphitisation, the preparatory thermal treatment using a rate of increase of temperature of 0.5° and 1° C. per minute up to 420° C., 0.1° to 0.5° C. per minute from 420° to 450° C. and 1° to 5° C. per minute beyond 450° C., the duration of irradiation by microwaves in the irradiation treatment being between 10 seconds and 15 minutes.

2. Process in accordance with claim 1, characterised in that the Conradson carbon content of the pre-treated fibres in greater than 83 percent by weight and is preferably at least 88 percent by weight.

3. Process in accordance with claim 1, characterised in that the preparatory thermal treatment is carried out in the presence of a gas which is nitrogen, argon, helium or hydrogen.

4. Process in accordance with claim 1, characterised in that the fibres have a Kraemer-Sarnow softening point of between 100° and 250° C., preferably between 180° and 250° C., and a Conradson carbon content of less than 80 percent by weight.

5. Process in accordance with claim 1, characterised in that the irradiation by microwaves uses an electromagnetic radiation of a frequency of between 900 and 30,000 MHz.

6. Process in accordance with claim 5, characterised in that the frequency of the electromagnetic radiation used is higher than 5000 MHz.

7. Process in accordance with claim 1, characterised in that the power of the electromagnetic radiation used is between 10 W and 30 kW.

8. Process in accordance with claim 1, characterised in that the temperature reached during the treatment by microwaves is between 400° and 2800° C.

9. Process in accordance with claim 1, characterised in that the irradiation by microwaves is carried out in an inert atmosphere.

10. Process in accordance with claim 9, characterised in that the irradiation by microwaves is carried out in an atmosphere of nitrogen, argon, helium or hydrogen.

11. Process in accordance with claim 1, characterised in that, prior to the preparatory thermal treatment there is an oxidation treatment up to a temperature ranging from 100° to 250° C.

12. Process in accordance with claim 11, characterised in that the oxidation treatment uses a rate of increase of temperature of 0.1° to 0.5° per minute.

13. Process in accordance with claim 11, characterised in that, when a fibre having a softening point lower than 150° C. is used, the oxidation treatment is carried out in the liquid phase in the presence of an oxidising agent chosen from nitric acid, sodium hypochlorite, hydrogen peroxide, potassium dichromate and, potassium permanganate.

14. Process in accordance with claim 11, characterised in that, when a fibre having a softening point higher than 150° C. is used, the oxidation treatment is carried out in the gaseous phase in the presence of oxygen, ozone or air.

* * * * *